US008170463B2

(12) United States Patent
Ogata et al.

(10) Patent No.: US 8,170,463 B2
(45) **Date of Patent: *May 1, 2012**

(54) SHEET PROCESSING APPARATUS AND IMAGE FORMING APPARATUS

(75) Inventors: Atsushi Ogata, Mishima (JP); Masayoshi Fukatsu, Sunto-gun (JP); Junichi Sekiyama, Numazu (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

This patent is subject to a terminal disclaimer.

(21) Appl. No.: 12/712,328

(22) Filed: Feb. 25, 2010

(65) Prior Publication Data

US 2010/0171256 A1 Jul. 8, 2010

Related U.S. Application Data

(63) Continuation of application No. 11/405,461, filed on Apr. 18, 2006, now Pat. No. 7,697,883.

(30) Foreign Application Priority Data

Apr. 26, 2005 (JP) ..... 2005-128083

(51) Int. Cl.
*B65H 31/26* (2006.01)
*G03G 15/00* (2006.01)

(52) U.S. Cl. ..... 399/405; 271/220; 271/224

(58) Field of Classification Search ..... 399/405; 271/220

See application file for complete search history.

(56) References Cited

U.S. PATENT DOCUMENTS 4,789,150 A 12/1988 Plain
5,741,009 A * 4/1998 Kawano et al. ..... 271/182
6,352,253 B1 3/2002 Hayakawa et al.
6,412,774 B1 7/2002 Saito et al.
6,722,646 B2 4/2004 Sekiyama et al.
6,735,415 B2 5/2004 Isobe et al.
6,942,206 B2 9/2005 Kuwata et al.
6,997,456 B2 2/2006 Fukatsu et al.
7,077,395 B2 7/2006 Ata et al.
7,258,339 B2 8/2007 Fukatsu et al.
7,341,248 B2 * 3/2008 Kuwata et al. ..... 270/58.08
7,697,883 B2 * 4/2010 Ogata et al. ..... 399/405
2004/0022567 A1 2/2004 Fukatsu et al.

(Continued)

FOREIGN PATENT DOCUMENTS

GB 2215313 A * 9/1989

(Continued)

*Primary Examiner* — Daniel J Colilla
*Assistant Examiner* — Nguyen Q Ha
(74) *Attorney, Agent, or Firm* — Fitzpatrick, Cella, Harper & Scinto

(57) ABSTRACT

The present invention provides a sheet processing apparatus that can prevent, with higher certainty, lift of the trailing end of each sheet placed in sheet stacking portion. This apparatus includes a first holding member and a second holding member that prevent lift of the trailing end of each sheet from an intermediate stacking portion. When introduced to the intermediate stacking portion, the subsequent sheet comes into contact with the first holding member, so that the first holding member moves to the retracting position. As the subsequent sheet continues to be conveyed, the subsequent sheet comes into contact with the second holding member, so that the second holding member moves from the restricting position to the retracting position. As the trailing end of the sheet is introduced, the first holding member moves from the retracting position to the restricting position, to hold down the trailing end of the sheet.

10 Claims, 15 Drawing Sheets

U.S. PATENT DOCUMENTS

| | | | |
|---|---|---|---|
| 2006/0082047 | A1 | 4/2006 | Fukatsu et al. |
| 2006/0239735 | A1 | 10/2006 | Ogata et al. |
| 2007/0231036 | A1 | 10/2007 | Fukatsu et al. |

FOREIGN PATENT DOCUMENTS

| | | | | |
|---|---|---|---|---|
| JP | 7-144812 | A | | 6/1995 |
| JP | 8-40621 | A | | 2/1996 |
| JP | 2000272808 | A | * | 10/2000 |
| JP | 2001130817 | A | * | 5/2001 |
| JP | 2001261225 | A | * | 9/2001 |
| JP | 2001328758 | A | * | 11/2001 |
| JP | 2001348155 | | | 12/2001 |
| JP | 2002087685 | A | * | 3/2002 |
| JP | 2002-211814 | A | | 7/2002 |
| JP | 2002241028 | A | * | 8/2002 |
| JP | 2002-293470 | A | | 10/2002 |
| JP | 2003-312925 | A | | 11/2003 |
| JP | 2004-59314 | A | | 2/2004 |
| JP | 2004299855 | | | 10/2004 |
| JP | 2004331244 | A | * | 11/2004 |
| JP | 2005001893 | A | * | 1/2005 |
| JP | 2005096965 | A | * | 4/2005 |

* cited by examiner

SHEET PROCESSING APPARATUS AND IMAGE FORMING APPARATUS

This application is a continuation application of copending U.S. patent application number 11/405,461, filed on Apr. 18, 2006.

BACKGROUND OF THE INVENTION

1. Field of the Invention

The present invention relates to a sheet processing apparatus that performs processing on sheets, and an image forming apparatus that is equipped with the sheet processing apparatus.

2. Description of the Related Art

In a conventional image forming apparatus such as a copying machine, a printer, and a facsimile machine, a sheet processing apparatus may comprise a sheet processing portion that supplies sheets having images formed thereon one by one into the apparatus and binds the sheets. With this sheet processing apparatus, the binding process to be performed on the sheets, such as copy sheets, on which image formation has been carried out can be omitted.

In the sheet processing apparatus disclosed in Japanese Unexamined Patent Publication No. 2004-59314, for example, sheets are discharged and stacked on an intermediate stacking portion by an intermediate roller. The end portions of the sheets stacked on the intermediate stacking portion are aligned on the intermediate stacking portion, and binding is performed by a binding device such as a stapler.

FIGS. 14 and 15 show a conventional sheet processing apparatus.

As shown in FIG. 14, this sheet processing apparatus has a trailing-end holding member 103 that prevents the top end of a subsequent sheet from running into the trailing end of a precedent sheet 104 placed on an intermediate stacking portion 101 lifted above the nip line of an intermediate roller 102, and also prevents misalignment and jamming.

This holding member 103 is provided on the downstream side of the nip position of the intermediate roller 102, and is energized in the opposite direction from the sheet conveying direction, as indicated by the arrow H. Accordingly, the position of the trailing end of the precedent sheet 104 is restricted by the lower end of the holding member 103, and is prevented from being lifted.

Therefore, the trailing end of the precedent sheet 104 is located lower than the nip line of the intermediate roller 102 before the holding member 103 rotates by the top end of the subsequent sheet. The top end of the subsequent sheet reaches a point on the downstream side deeper than the trailing end of the precedent sheet when the holding member 103 rotates. Thus, the top end of the subsequent sheet does not run into the trailing end of the precedent sheet 104.

However, in a case where each sheet is tightly curled, for example, the trailing end of a precedent sheet might lean on an alignment reference wall 105.

In that case, the holding member 103 is not energized in such a direction as to push the sheet against the sheet stacking face of the intermediate stacking portion 101. As a result, the holding member 103 cannot return to its original position due to the leaning of the precedent sheet 104, as shown in FIG. 15. The trailing end of the precedent sheet 104 cannot be restricted to a lower position than the nip line of the intermediate roller 102, and the subsequent sheet runs into the trailing end of the precedent sheet 104, causing damage or jamming of the sheets.

SUMMARY OF THE INVENTION

Therefore, the object of the present invention is to provide a sheet processing apparatus that can prevent, with higher certainty, lift of the trailing end of each sheet stacked on the sheet stacking portion.

To achieve above-mentioned object, there is provided a sheet processing apparatus comprising:

a sheet stacking portion in which sheets conveyed along a sheet conveying path are placed;

a first restriction member and a second restriction member which prevent lift of an end portion of each sheet conveyed along the sheet conveying path and placed in the sheet stacking portion; and a supporting portion (supporting means) which supports the first restriction member and the second restriction member each movably between a restricting position in which lift of the end portion of each sheet placed in the sheet stacking portion is prevented and a retracting position to which each restriction member is retracted from the restricting position, wherein the second restriction member moves from the restricting position to the retracting position after the first restriction member moves from the restricting position to the retracting position as each sheet conveyed along the sheet conveying path is introduced to the sheet stacking portion, the first restriction member moves from the retracting position to the restricting position as each sheet passes, the second restriction member then moves from the retracting position to the restricting position.

According to the present invention, lift of the trailing end of each sheet stacked on the sheet stacking portion can be prevented with higher certainty.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
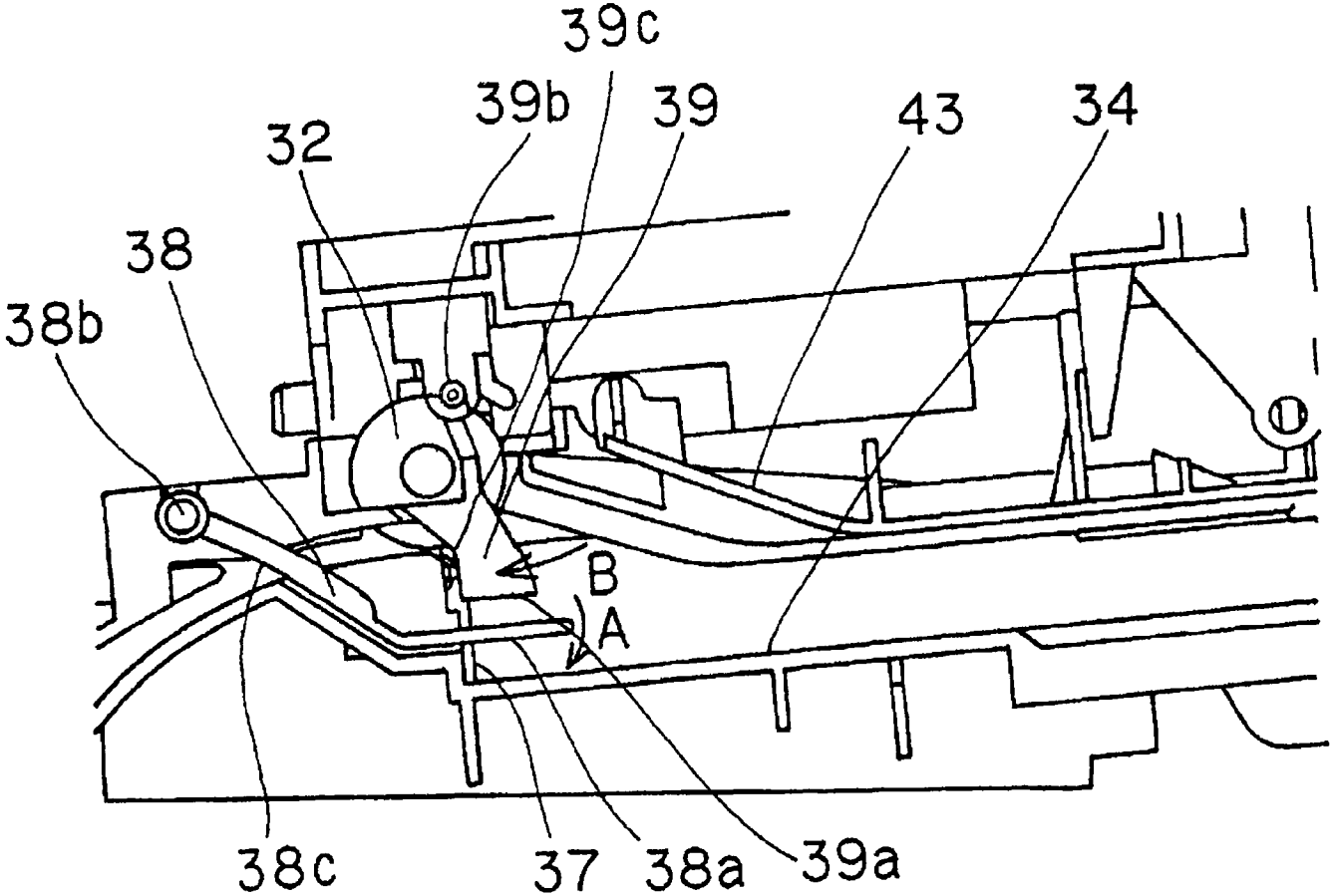
FIG. 1 is a schematic cross-sectional view of a sheet processing portion in accordance with a first embodiment of the present invention.

The following is a description of embodiments of the present invention, with reference to the accompanying drawings. In those drawings, like components are denoted by like reference numerals. The sizes, materials, shapes, and arrangement of the components described below may be changed with the structures and conditions to which the present invention is applied, and the present invention is not limited to the following embodiments.

(First Embodiment)

Figure 2:
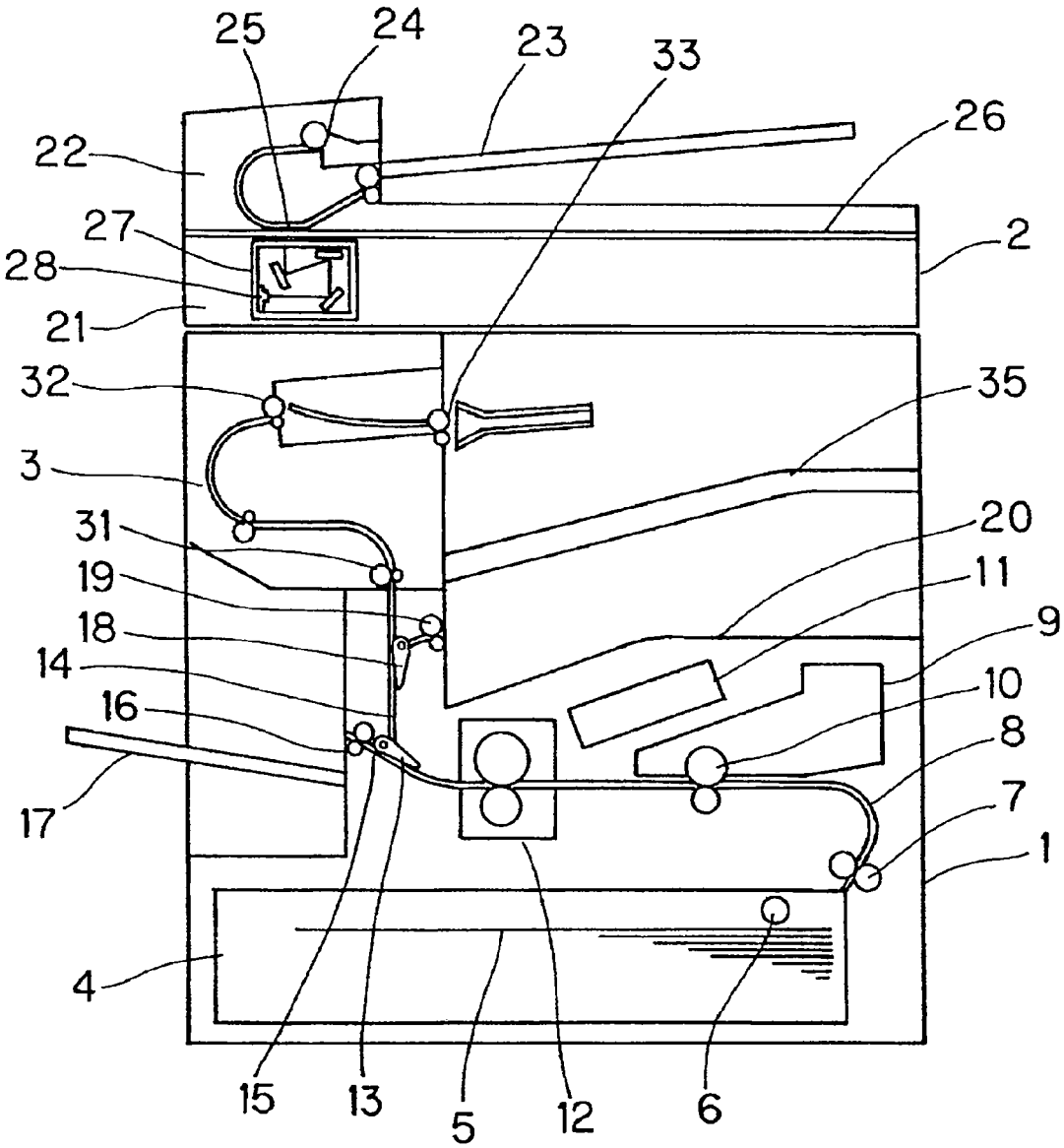
FIG. 2 is a schematic cross-sectional view of an image forming apparatus in accordance with the first embodiment of the present invention.

FIG. 2 shows an image forming apparatus as a sheet processing apparatus in accordance with a first embodiment of the present invention. As shown in FIG. 2, the image forming apparatus in accordance with the first embodiment includes an image forming portion 1, an image reading portion 2, and a sheet processing portion 3. The image forming portion 1 forms an image on a sheet. The image reading portion 2 reads the information from the sheet. In the first embodiment, the sheet processing portion 3 is an independent unit that performs predetermined processing such as stapling on the sheet having an image formed thereon by the image forming portion 1. However, the sheet processing portion 3 may be integrally incorporated into the image forming portion 1. The sheet processing portion 3 is interposed between the image forming portion 1 and the image reading portion 2, and are connected to each other.

Also as shown in FIG. 2, the image forming portion 1 separates and conveys sheets stacked on a feed cassette 4 by a feed roller 6 and a separation conveyance roller 7. The sheets are conveyed along a conveyance guide 8 one by one to an image forming process unit 9.

The image forming process unit 9 forms images (toner images) by the electrophotographic technology. More specifically, in the image forming process unit 9, a laser scanner 11 illuminates a photosensitive drum 10 as a charged image bearing member, so as to form an image. The image is then developed with toner, and the toner image is transferred to the sheet 5.

The sheet 5 having the toner image transferred from the photosensitive drum 10 is conveyed to a fixing unit 12, and heat and a voltage are applied to the sheet 5 so as to fix the image to the sheet 5.

The sheet 5 to which the image is fixed is sent either to a face-down conveying path 14 or to a face-up conveying path 15 by a first conveying path switching flapper 13. The face-down conveying path 14 is a sheet conveying path for conveying a sheet to the upper side of the image forming portion 1, and the face-up conveying path 15 is a sheet conveying path for conveying a sheet to a side of the image forming portion 1.

Each sheet guided to the face-up conveying path 15 is discharged and stacked onto a face-up tray 17 by a face-up discharge roller 16.

On the other hand, each sheet guided to the face-down conveying path 14 is further guided by a second conveying path switching flapper 18, and is sent either to a path leading to a face-down tray 20 or to a path leading to the sheet processing portion 3 above by a face-down discharge roller 19.

As shown in FIG. 2, the image reading portion 2 includes a scanner portion 21 and an automatic document feeder (hereinafter referred to as the ADF) 22. Documents stacked on a document tray 23 are separated from one another and fed into the ADF 22 by a feed roller 24, and the separated documents are conveyed through a document reading position 25 in which an optical carriage 27 of the scanner portion 21 is located. The ADF 22 can also be opened backward and closed about a hinge (not shown) provided at the back of the apparatus. The ADF is opened and closed when a document is placed on a document glass 26.

The scanner portion 21 includes the movable optical carriage 27 to read information from documents. In the scanner portion 21, the optical carriage 27 moves in the horizontal direction to read information from a document placed on the document glass 26, and the read information is photoelectrically converted by a CCD 28. At the time of document reading by the ADF 22 described above, the optical carriage 27 stops in the document reading position 25 to read information from the document being conveyed.

Figure 3:
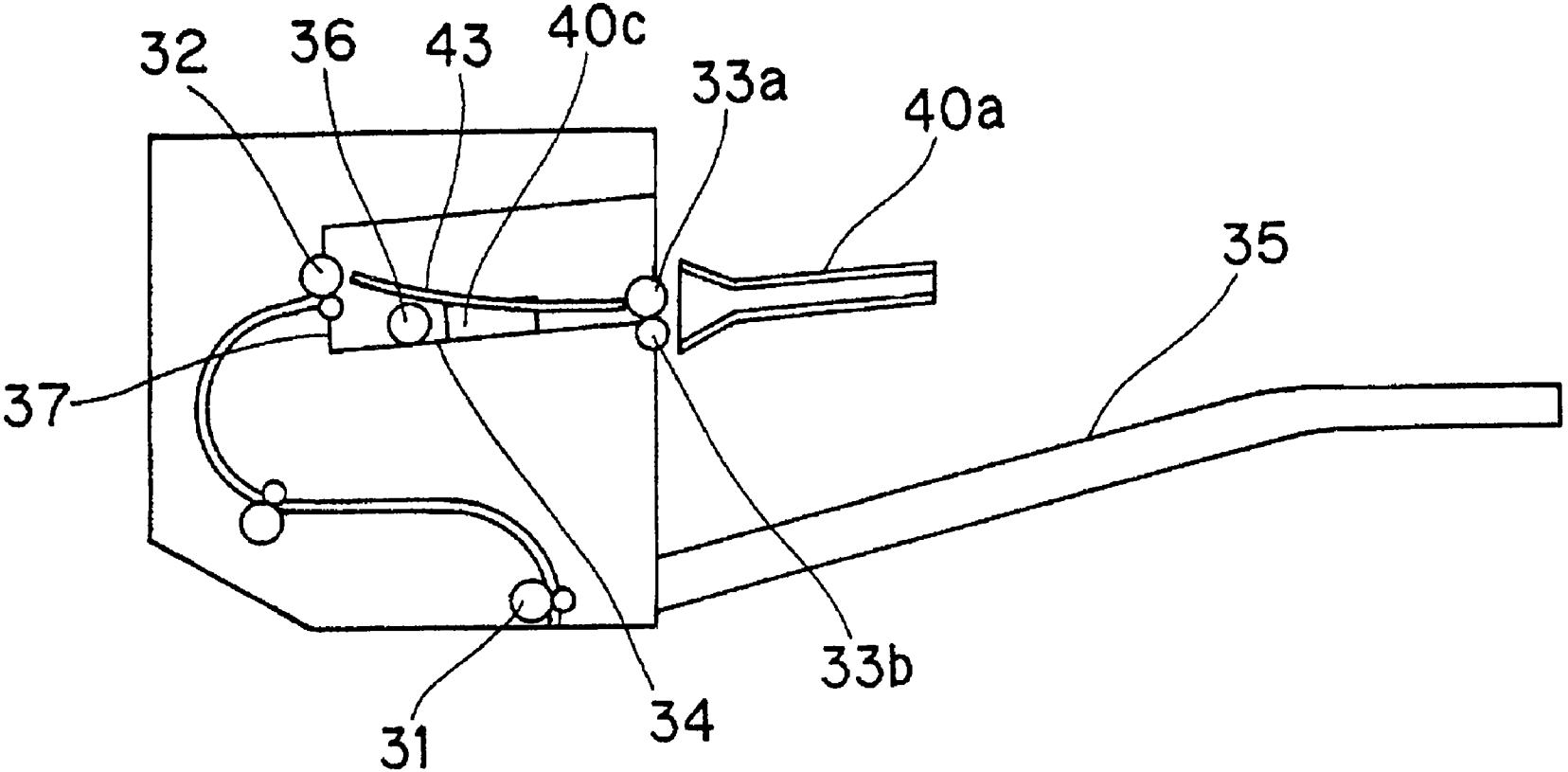
FIG. 3 is a schematic cross-sectional view of a sheet processing portion in accordance with the first embodiment of the present invention.

FIG. 3 is a schematic cross-sectional view of showing the structure of the sheet processing portion 3. The sheet processing portion 3 performs stapling on each sheet that is conveyed to the upper portion of the image forming portion 1 by the second conveying path switching flapper 18. As shown in FIG. 3, the sheet processing portion 3 has an inlet roller 31, an intermediate conveyance roller 32, and discharge rollers 33 (33*a* and 33*b*). The sheet processing portion 3 further includes an intermediate stacking portion 34 as a sheet stacking portion, a stacking tray 35, an alignment roller 36 that aligns sheets in a conveying direction, a first alignment reference wall 37 of sheet conveying direction, and a conveying guide 43 above the intermediate stacking portion 34.

FIG. 1 shows the structure of the neighborhood area of the intermediate conveyance roller 32. In FIG. 1, reference numeral 38 denotes a first holding member as a first control member, and reference numeral 39 denotes a second holding member as a second control member.

The first holding member 38 has a supporting point 38*b* as a swinging axis forming a supporting portion (supporting means) according to the present invention. The supporting point 38*b* is located on the upstream side of the nip position of the intermediate conveyance roller 32. The first holding member 38 is supported rotatably, swingably, and movably, and is energized in the direction of the arrow A by an energizing member (energizing means) such as a spring. The energizing force of the energizing member (energizing means) is smaller than the pushing force of the sheet being conveyed, so that the first holding member 38 is rotated by the sheet being conveyed despite the energizing force, and the sheet being conveyed is not damaged. Instead of the energizing member (energizing means) such as a spring, the first holding member 38 may be designed to energize itself toward the restricting position by its own weight. The restricting position is the position at which the first holding member 38 runs into a stopper (not shown) and comes to rest.

As a first contact portion 38*c* is pushed by the sheet being conveyed, the first holding member 38 rotates (swings or moves) counterclockwise in the drawing, and is retracted to an upper position (a retracting position). The first holding member 38 is located in a position (the restricting position) at a predetermined distance from the stacking face of the intermediate stacking portion 34 when no sheets are being conveyed. In the schematic cross-sectional view of FIG. 1, a lower face 38*a* crosses the first alignment reference wall 37. Here, the first contact portion 38*c* is located on the downstream side of the supporting point 38*b* in the first holding member 38.

The second holding member 39 is rotatably supported about a supporting point (a swinging axis) 39*b* forming a supporting portion (supporting means), so as to be in contact with the top end of a sheet on the downstream side of the nip position of the intermediate conveyance roller 32. The second holding member 39 is energized in the direction of the arrow B by an energizing member (energizing means) such as a spring. This energizing member (energizing means) has substantially the same energizing force as that of the energizing member (energizing means) energizing the first holding member 38. The position in which the second holding member 39 is stopped by a stopper (not shown) is the restricting position of the second holding member 39.

While a sheet is being conveyed, a second contact portion 39*c* is pushed by the sheet, so that the second holding member 39 rotates counterclockwise in the drawing and is retracted from the restricting position to an upper position (the retracting position). When no sheets are being conveyed, or when the first holding member 38 and the second holding member 39 are located in the respective restricting positions, the lower face 38*a* of the first holding member 38 is located in a lower position than the lower face 39*a* of the second holding member 39. Here, the first contact portion 38*c* is located on the upstream side of the second contact portion 39*c*. As described above, in the supporting portion (supporting means) according to the present invention, the first contact portion 38*c* and the second contact portion 39*c* are pushed by a sheet, so that the first holding member 38 and the second holding member 39 are moved. This supporting portion (supporting means) according to the invention is constructed so as to move the first holding member 38 and the second holding member 39 from the respective restricting positions to the respective retracting positions while the first contact portion 38*c* and the second contact portion 39*c* are contacting with the sheet.

Figure 4:
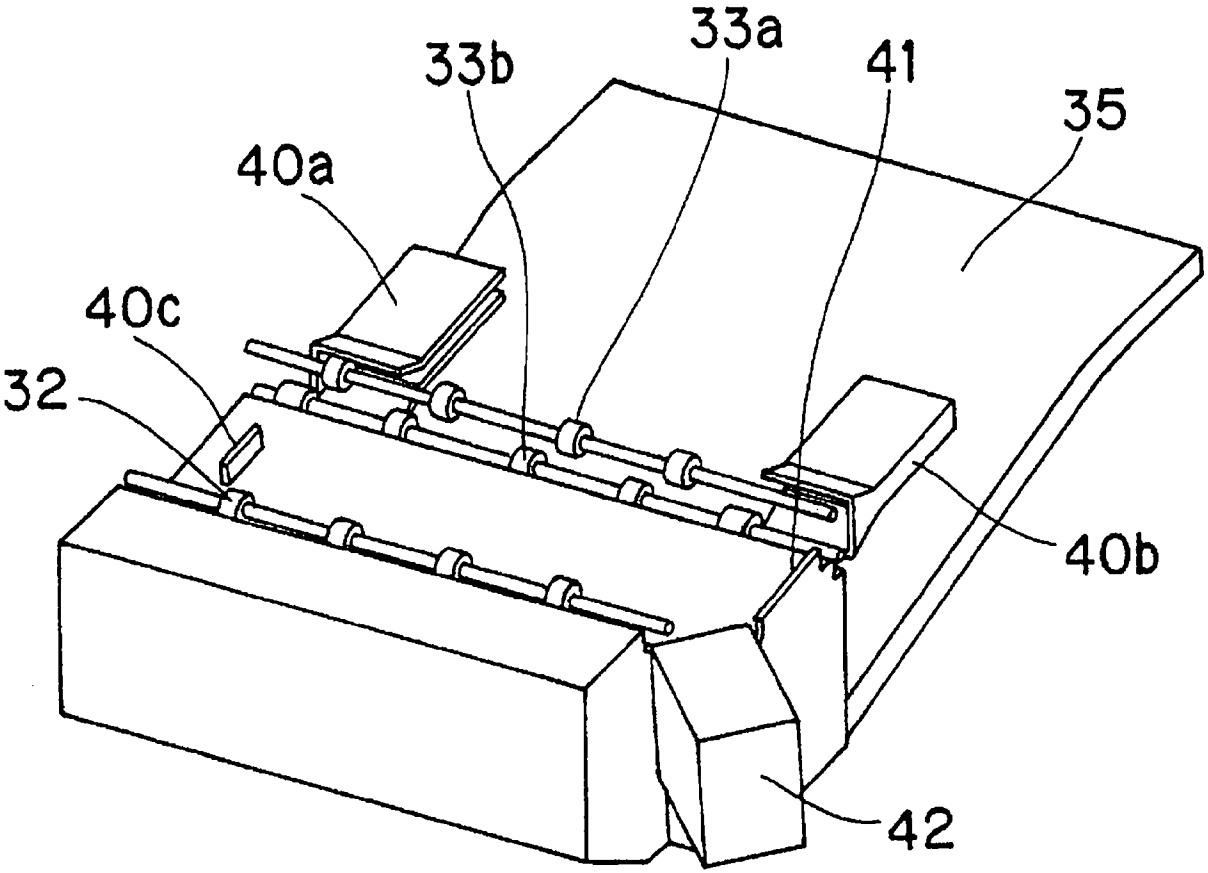
FIG. 4 is a perspective view of the sheet processing portion in accordance with the first embodiment of the present invention.

FIG. 4 is a top view of the intermediate stacking portion 34. In FIG. 4, reference numerals 40*a*, 40*b*, and 40*c* denote joggers that align sheets in a direction perpendicular to the sheet conveying direction, reference numeral 41 denotes a second alignment reference wall of a direction perpendicular to the sheet conveying direction, and reference numeral 42 denotes a stapler that binds the aligned sheets. The discharge roller 33 is supported in such a manner that the upper roller 33*a* can be at a distance from the lower roller 33*b*. While sheets are being aligned, the upper roller 33*a* is kept at a distance from the sheets, so that the alignment can be carried out in the discharge roller 33. After the stapling is completed, the sheets are again nipped and discharged onto the stacking tray 35.

Of the joggers 40*a*, 40*b*, and 40*c*, the joggers 40*a* and 40*b* are located on the downstream side of the discharge rollers 33*a* and 33*b*, and each have such a shape as to be able to support the upper and lower faces of sheets in a stack. The joggers 40*a* and 40*b* can be retracted up to such a position that the lower face of each of the joggers 40*a* and 40*b* comes outside the width of each sheet and stapled sheets can be discharged onto the stacking tray 35. The jogger 40*c* located on the upstream side of the discharge rollers 33*a* and 33*b* is pushed and moved by the jogger 40*a*, so that the jogger 40*a* and the jogger 40*c* can synchronously align sheets. The alignment roller 36 can be moved up and down in relation to the sheet stacking face of the intermediate stacking portion 34. When being moved down, the alignment roller 36 is moved to such a position as to be in contact with the surface of the top sheet on the intermediate stacking portion 34. When being moved up, the alignment roller 36 is moved to such a position as not to hinder conveyance of sheets onto the intermediate stacking portion 34.

(Sheet Processing)

Next, the sheet processing by the sheet processing portion 3 is described.

When a sheet is conveyed to the sheet processing portion 3, the sheet conveyed by the inlet roller 31 is discharged into the intermediate stacking portion 34 by the intermediate conveyance roller 32. Before the sheet enters the intermediate stacking portion 34, the joggers 40*a*, 40*b*, and 40*c* are moved to such positions that the alignment face for pushing the sheet is wider than the sheet conveying region by a predetermined amount. Even after the joggers 40*a*, 40*b*, and 40*c* are moved to such positions, the lower face of the sheet is supported by the joggers 40*a* and 40*b*. The discharge roller 33*a* moves to the non-contact position shown in FIG. 4 and stops rotating by the time when the trailing end of the sheet comes out of the intermediate conveyance roller 32 at the latest. In this manner, the sheet that has come out of the intermediate conveyance roller 32 is placed in the intermediate stacking portion 34.

Referring now to FIGS. 5 through 8, the operations of the first holding member 38 and the second holding member 39 at the time of sheet conveyance are described.

FIGS. 5 through 8 show the situation in which a subsequent sheet S2 is conveyed and placed in the intermediate stacking portion 34 while a precedent sheet S1 is already in the intermediate stacking portion 34.

Figure 5:
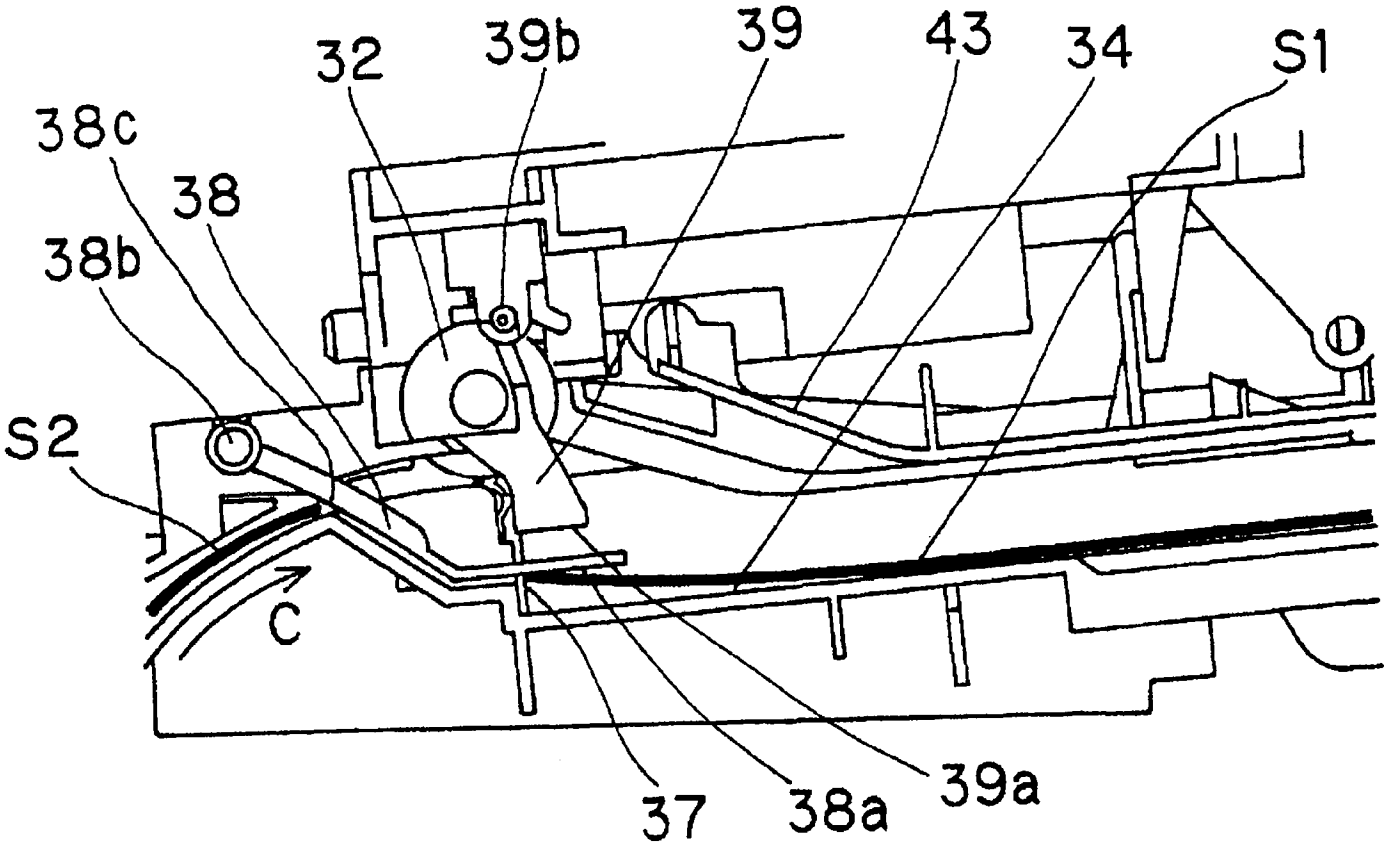
FIG. 5 is a schematic cross-sectional view of the sheet processing portion in accordance with the first embodiment of the present invention.
Figure 6:
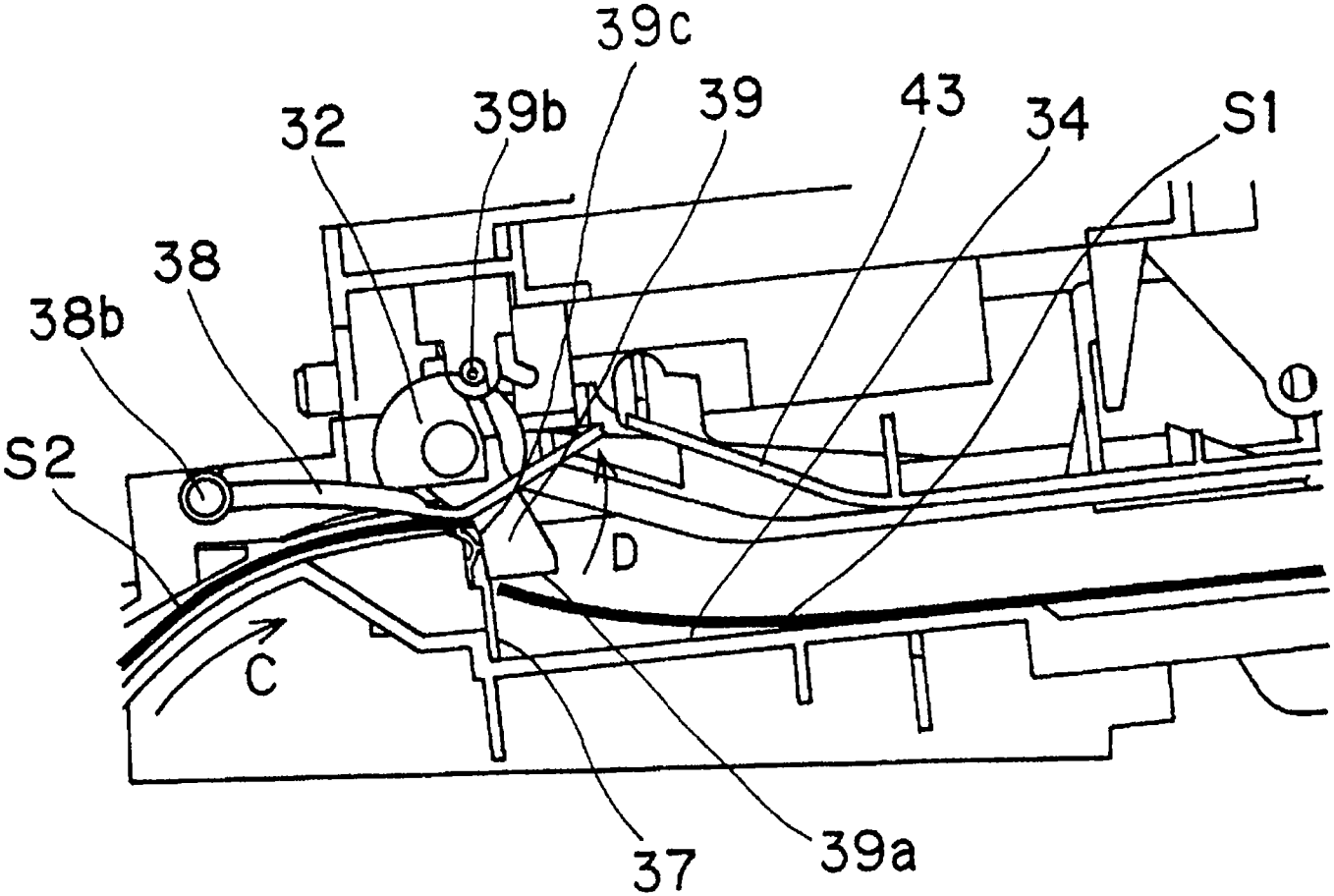
FIG. 6 is a schematic cross-sectional view of the sheet processing portion in accordance with the first embodiment of the present invention.

In FIG. 5, the first holding member 38 and the second holding member 39 are in the restricting positions. The subsequent sheet S2 is conveyed in the direction of the arrow C shown in FIG. 5, and the top end of the sheet is brought into contact with the first holding member 38 before reaching the intermediate conveyance roller 32. As shown in FIG. 6, as the subsequent sheet S2 is conveyed, the first holding member 38 rotates in the direction of the arrow D. By doing so, the first holding member 38 moves to the retracting position (see FIG. 6). The top end of the subsequent sheet S2 is energized by the weight of the first holding member 38, and is stably guided to the nip position of the intermediate conveyance roller 32. The lift of the trailing end of the precedent sheet S1 already placed in the intermediate stacking portion 34 is held below the nip line of the intermediate conveyance roller 32 by the second holding member 39.

Figure 7:
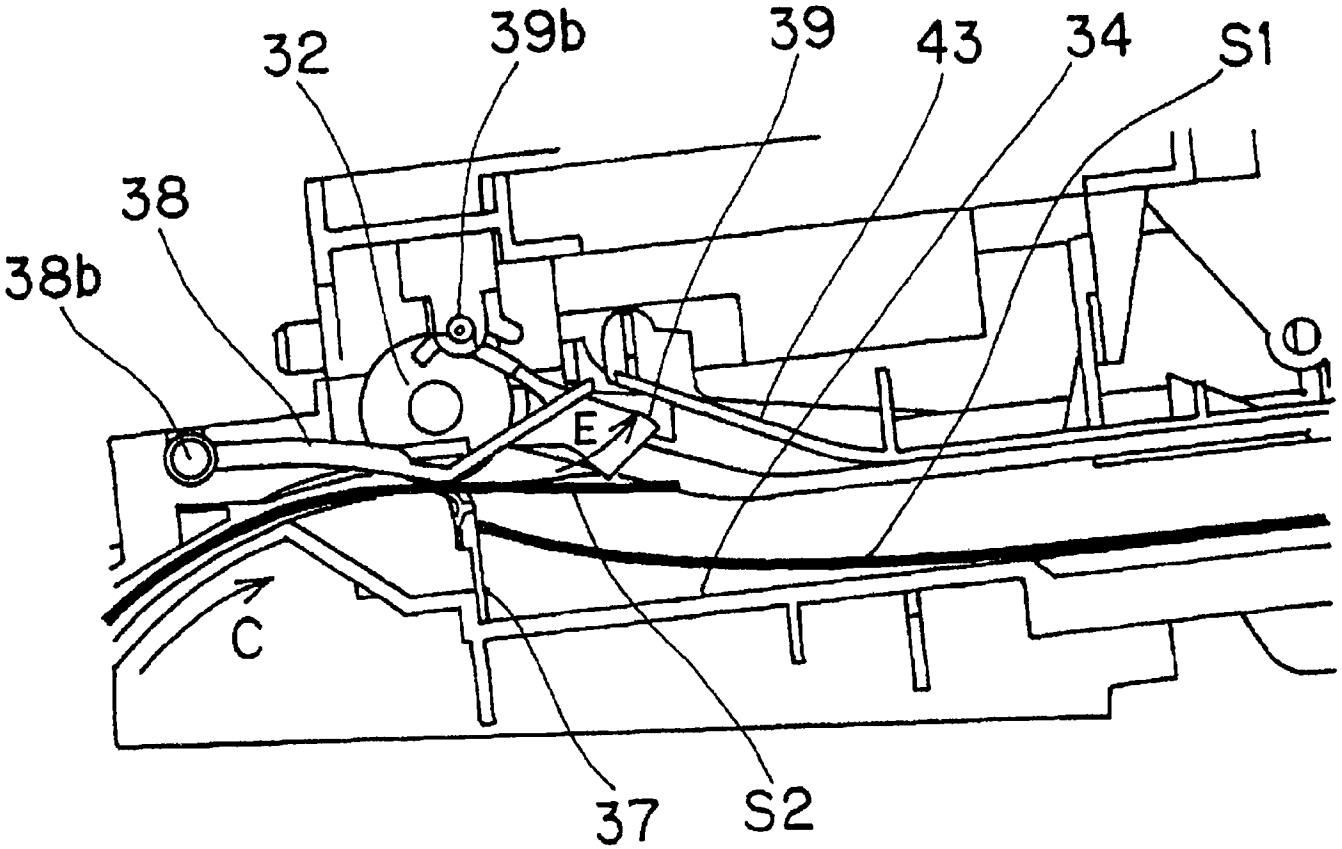
FIG. 7 is a schematic cross-sectional view of the sheet processing portion in accordance with the first embodiment of the present invention.

When the top end of the subsequent sheet S2 is nipped by the intermediate conveyance roller 32 and is brought into contact with the second holding member 39, the second holding member 39 rotationally moves in the direction of the arrow E shown in FIG. 7 and is retracted to the retracting position. When the second holding member 39 starts being rotationally moved up by the sheet, the top end of the subsequent sheet S2 and the trailing end of the precedent sheet S1 are located substantially in the same positions in terms of the sheet conveying direction but are in different positions in terms of the height direction. When the trailing end of the precedent sheet S1 is lifted as the second holding member 39 rotationally moves up, the top end of the subsequent sheet S2 already reaches the downstream side of the trailing end of the precedent sheet S1. Accordingly, the top end of the subsequent sheet S2 does not run into the trailing end of the precedent sheet S1. The first holding member 38 and the second holding member 39 need to be set in advance at the optimum distance from each other, so that the above effects can be achieved for both the precedent sheet S1 and the subsequent sheet S2.

When coming out of the nip of the intermediate conveyance roller 32, the trailing end of the subsequent sheet S2 moves apart from the first contact portion 38*c* of the first holding member 38 at the same time. Accordingly, as shown in FIG. 8, the first holding member 38 rotationally moves in the direction of the arrow F, to return to the predetermined restricting position, and the trailing ends of the subsequent sheet S2 and the precedent sheet S1 are held by the intermediate stacking portion 34.

The first holding member 38 has the supporting point 38*b* located on the upstream side of the intermediate conveyance roller 32 and the first contact portion 38*c*, and is arranged so that the top end of a sheet is brought into contact on the upstream side of the intermediate conveyance roller 32. In the restricting position, the lower face 38*a* of the first holding member 38 extends crossing the first alignment reference wall 37 from the upstream side to the downstream side of the intermediate conveyance roller 32. Thereby, the lower face 38*a* of the first holding member 38 can prevent from leaning of each sheet on the first alignment reference wall 37. Further, the first holding member 38 is energized in the direction of pushing the trailing end of a sheet placed on the intermediate stacking portion 34 against the sheet stacking face of the intermediate stacking portion 34. Accordingly, even if the trailing end of the sheet is tightly curled, the trailing end of the sheet can be pushed against the sheet stacking face of the intermediate stacking portion 34 with certainty.

Figure 8:
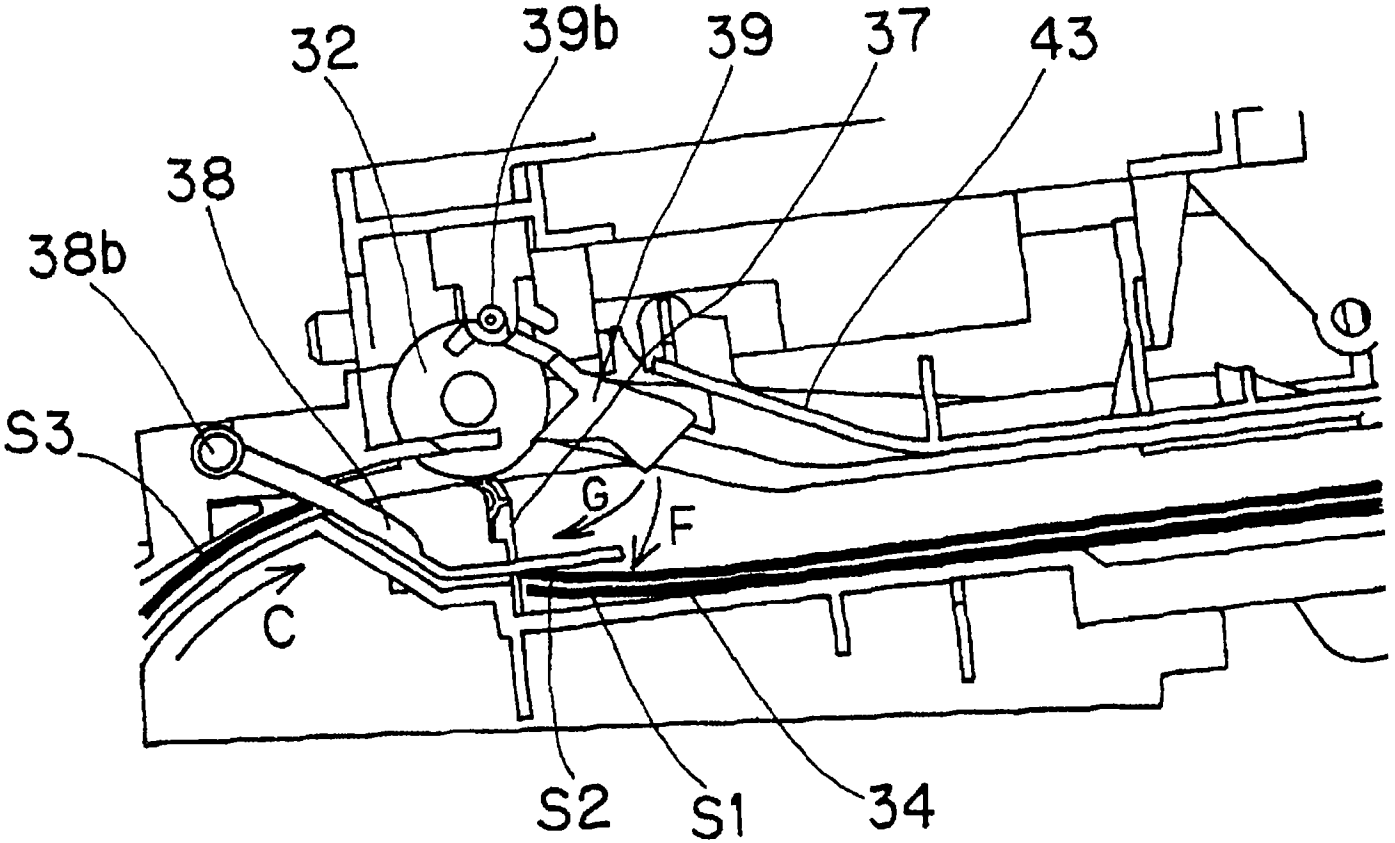
FIG. 8 is a schematic cross-sectional view of the sheet processing portion in accordance with the first embodiment of the present invention.

When the subsequent sheet S2 comes out of the intermediate conveyance roller 32, the second holding member 39 also rotationally moves in the direction of the arrow G by virtue of the energizing force, to return to the predetermined position (refer to FIG. 8). Since the trailing end of the sheet is held by the first holding member 38, the second holding member 39 can return to the predetermined restricting position, without being hindered by the lift of the trailing end of the sheet. Thus, at the time of conveyance of the next sheet S3, the second holding member 39 is back in the position shown in FIG. 5.

After all the sheets are placed in the intermediate stacking portion 34 in this manner, the sheets are aligned in the width direction by moving the joggers. The jogger 40*b* on the reference side is fixed in the same plane as the second alignment reference wall 41. The jogger 40*a* and the jogger 40*c*, which operates in synchronization with the jogger 40*a*, move the sheets toward the second alignment reference wall 41, thereby aligning the sheets in the width direction.

The alignment roller 36 then moves down to come into contact with the surface of the sheet, so as to move the sheets toward the first alignment reference wall 37. Thus, alignment in the sheet conveying direction is performed.

The above operation is repeated until the predetermined number of sheets to be stapled together are stacked. When alignment for the last sheet is completed, the stapler 42 is driven to bind the sheets, while the joggers 40*a* and 40*c* are in contact with the end faces of the sheets in the end of alignment. The lower faces of the joggers 40*a* and 40*b* are then retracted to positions outside the width of each sheet, and the discharge rollers 33*a* and 33*b* nip and convey the stack of sheets onto the stacking tray 35. Thus, the stack of sheets is discharged and placed on the stacking tray 35.

In the restricting position of the first holding member 38, the location of the lower face 38*a* in relation to the stacking face of the intermediate stacking portion 34 is set so as to keep substantially the same clearance as the largest thickness of a sheet stack that can be stapled by the stapler 42. The trailing end of the precedent sheet S1 is kept to such a position that the top end of the subsequent sheet S2 does not run into the trailing end of the precedent sheet S1, and, at the same time, the first holding member 38 prevents lift of the trailing end of each sheet while sheet alignment is being performed. By doing so, the first holding member 38 hinders sheet movement, and imperfect alignment can be prevented.

Figure 9:
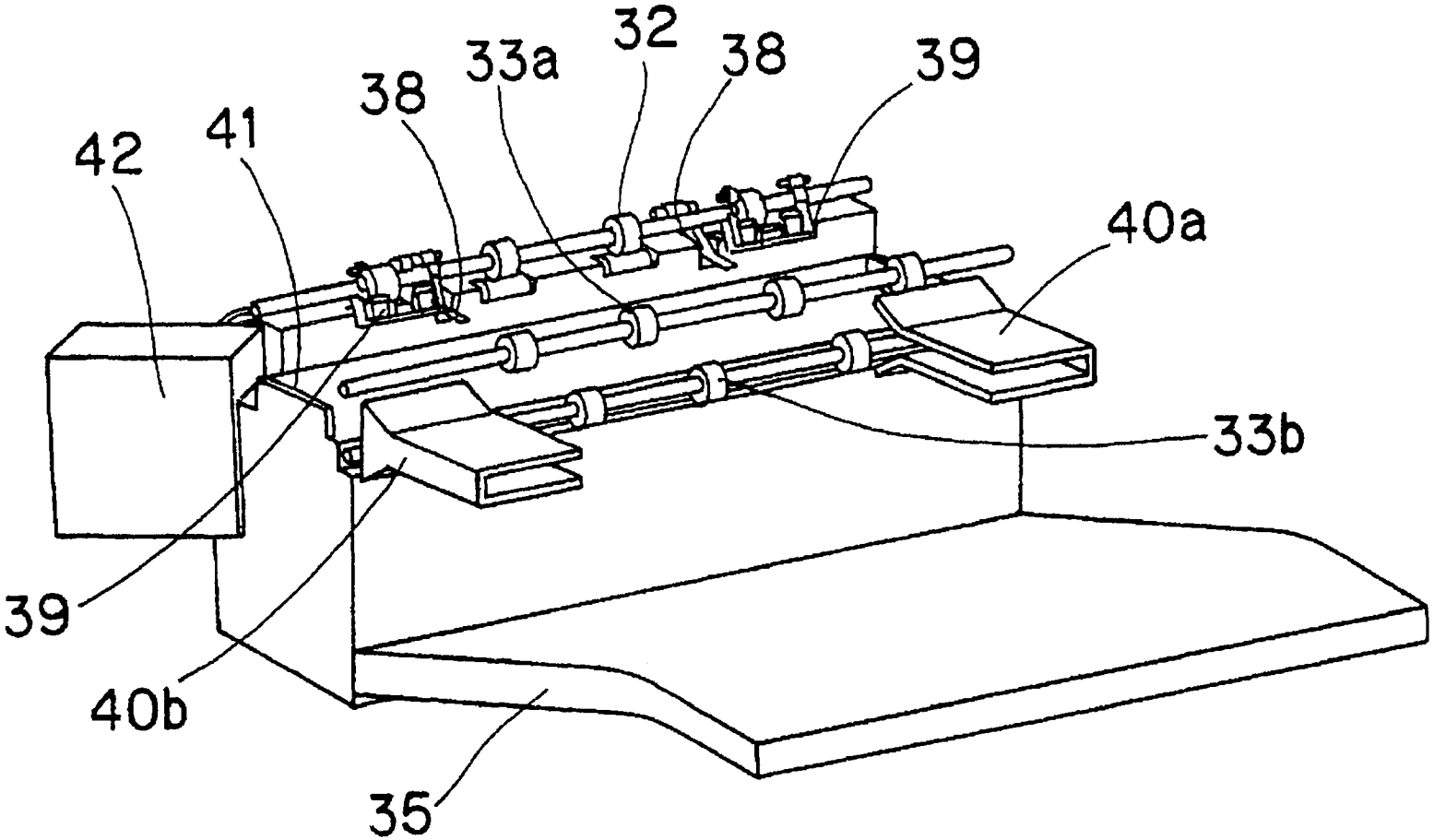
FIG. 9 is a perspective view of the sheet processing portion in accordance with the first embodiment of the present invention.

As shown in FIG. 9, the first holding members 38 and the second holding members 39 are arranged in a direction substantially perpendicular to the sheet conveying direction, and are specifically designed to hold both ends of each sheet with high probability of being lifted in the intermediate stacking portion 34.

As described so far, in the first embodiment of the present invention, sheet processing is performed in the sheet processing apparatus. Accordingly, lift of the trailing end of each sheet stacked in the intermediate stacking portion can be restrained, and damage to sheets and jamming of sheets can be prevented.

Although sheets are stacked in the intermediate stacking portion for performing sheet processing inside the sheet processing apparatus in the first embodiment as described above, the present invention is not limited to that structure. The present invention can be suitably implemented in any structure in which sheets are stacked in a stacking portion.

(Second Embodiment)

Figure 10:
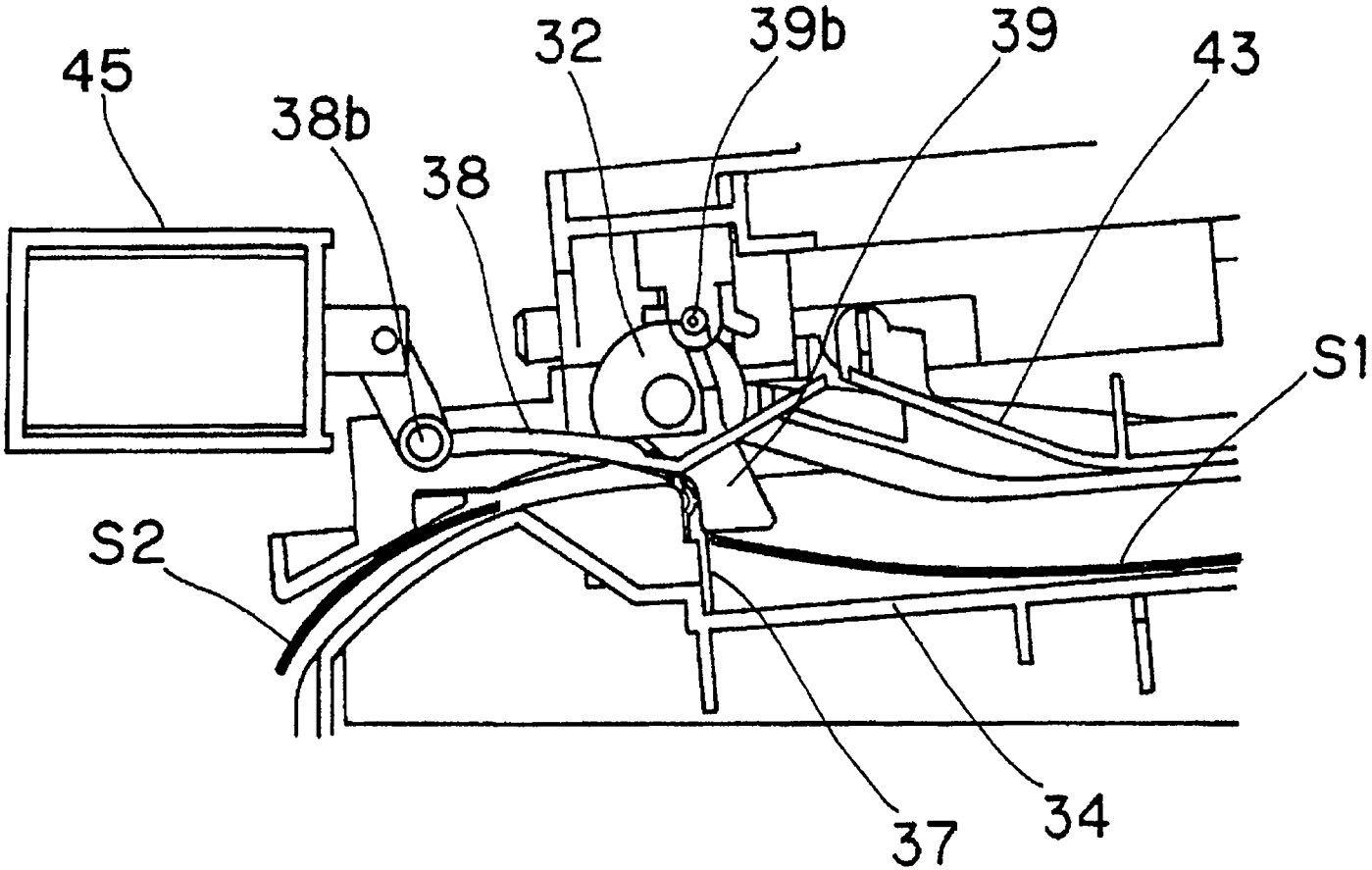
FIG. 10 is a schematic cross-sectional view of a sheet processing portion in accordance with a second embodiment of the present invention.
Figure 11:
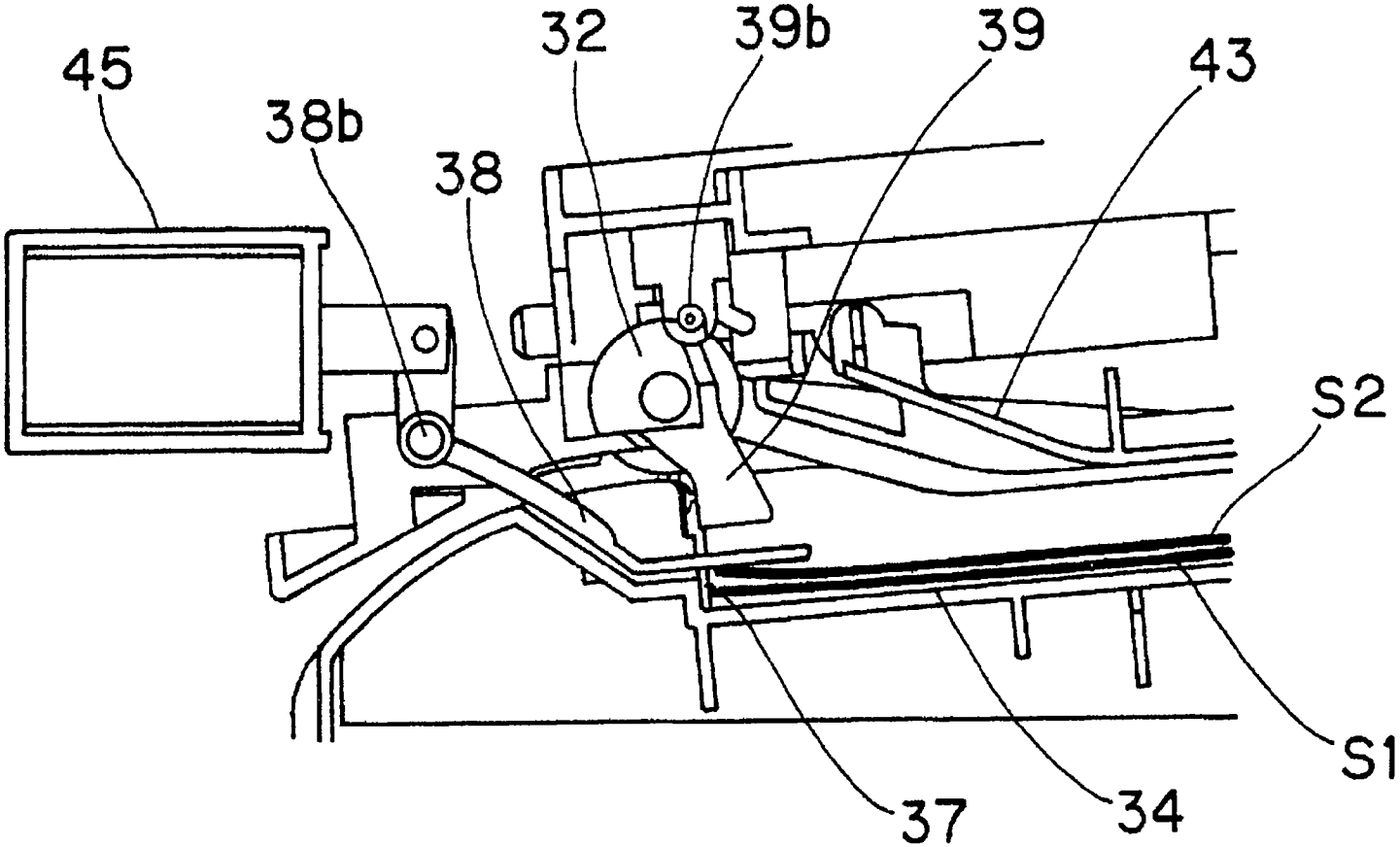
FIG. 11 is a schematic cross-sectional view of the sheet processing portion in accordance with the second embodiment of the present invention.

Next, a sheet processing apparatus in accordance with a second embodiment of the present invention is described. FIGS. 10 and 11 show the second embodiment of the present invention. Explanation of the same components as those of the first embodiment is not repeated here.

The structure of the second embodiment includes a solenoid 45 as a switching unit (switching means) for driving the first holding member 38. With the solenoid 45, the location of the first holding member 38 is switched between the retracting position shown in FIG. 10 and the restricting position shown in FIG. 11.

When the subsequent sheet S2 is conveyed, a sensor as a sheet detecting portion (sheet detecting means) detects the existence of the subsequent sheet S2. With that, the switching unit (switching means) drives the solenoid 45 to retract the first holding member 38 to the retracting position before the subsequent sheet S2 is brought into contact with the first holding member 38 as shown in FIG. 10. At this point, the precedent sheet S1 in the intermediate stacking portion 34 is held down by the second holding member 39.

After the subsequent sheet S2 comes out of the intermediate conveyance roller 32, the solenoid 45 is released as shown in FIG. 11. Accordingly, the first holding member 38 is positioned in the restricting position to hold down the trailing end of the subsequent sheet S2. The solenoid 45 may be released after the sensor detects the sheet having come out of the intermediate conveyance roller 32. However, it is also possible to release the solenoid 45 after a predetermined period of time has passed since the start of driving of the solenoid 45.

When the subsequent sheet S2 is conveyed, the switching of the locations of the first holding member 38 is performed by the solenoid 45, instead of the first holding member 38 being rotationally moved by the top end of the subsequent sheet S2 coming into contact with the first holding member 38. Accordingly, even if the energizing force to be applied to move the first holding member 38 to the restricting position is increased, the top end of the subsequent sheet S2 is not damaged. Thus, the trailing end of each sheet in the intermediate stacking portion 34 can be held down with a great force, and lift of a sheet can be prevented with higher certainty, compared with the case in the first embodiment.

In the second embodiment, the solenoid 45 is driven to move the first holding member 38 to the retracting position. However, the structure of the second embodiment is not limited to that. The first holding member 38 may be moved to the restricting position shown in FIG. 11 by driving the solenoid 45.

Alternatively, the second holding member 39 may be moved by the solenoid 45. More specifically, the first holding member 38 or the second holding member 39, whichever is not moved by the solenoid 45, may have a contact portion with which the top end of each sheet is to be brought into contact as in the first embodiment. In such a case, the top end of a sheet is brought into contact with the contact portion so as to rotationally move the holding member.

(Third Embodiment)

Figure 12:
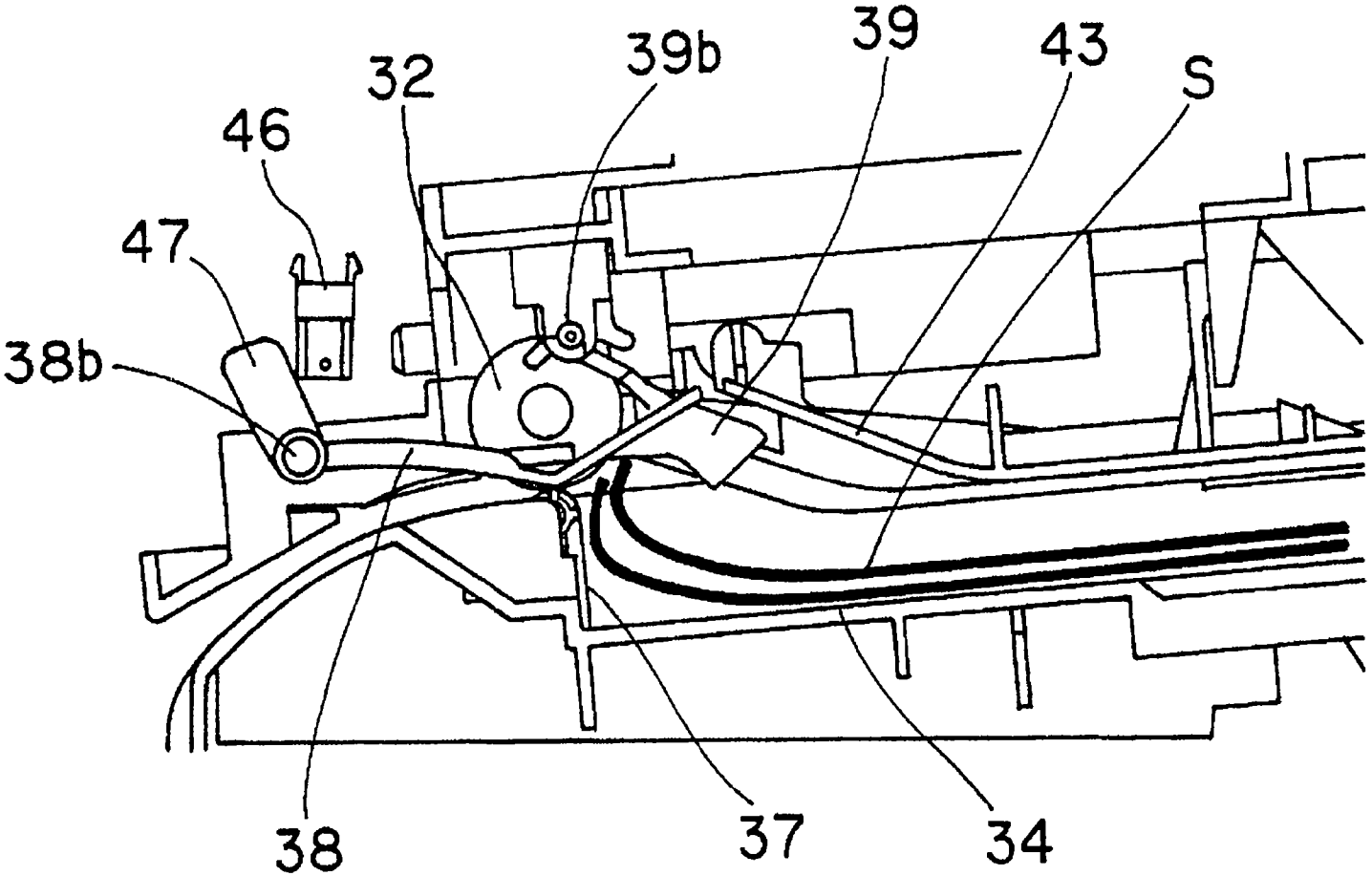
FIG. 12 is a schematic cross-sectional view of a sheet processing portion in accordance with a third embodiment of the present invention.
Figure 13:
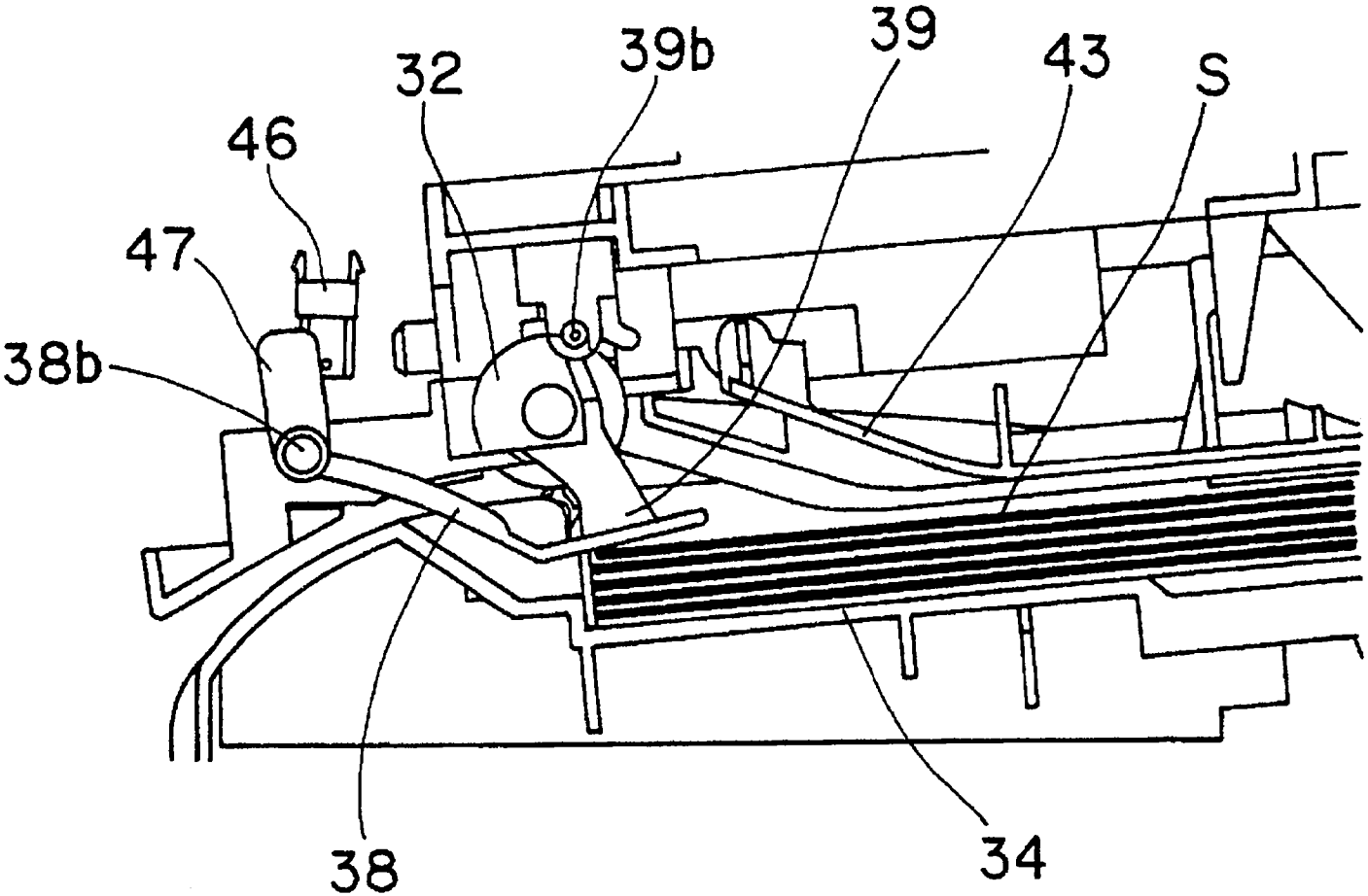
FIG. 13 is a schematic cross-sectional view of the sheet processing portion in accordance with the third embodiment of the present invention.
Figure 14:
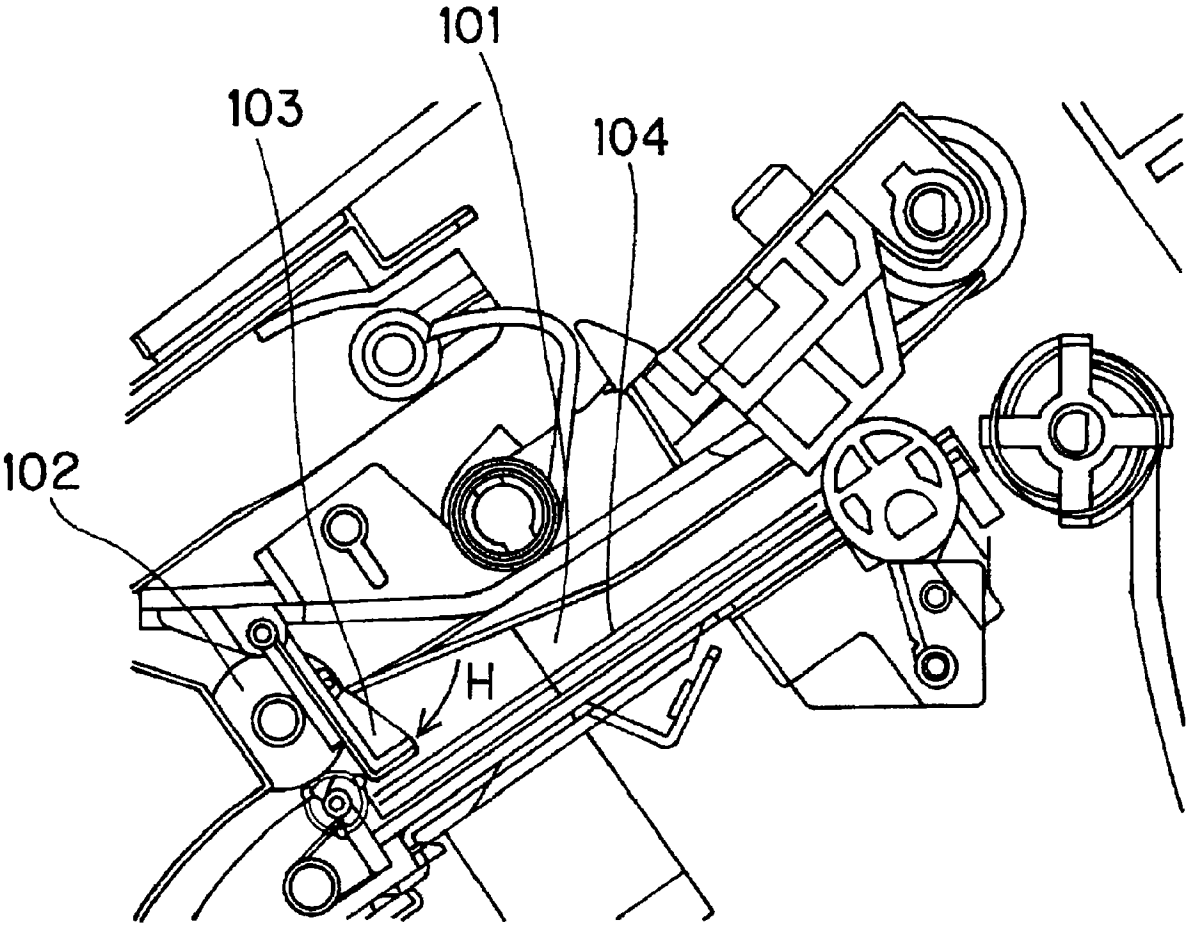
Fig.14 PRIOR ART
FIG. 14 is a view showing the prior art.
Figure 15:
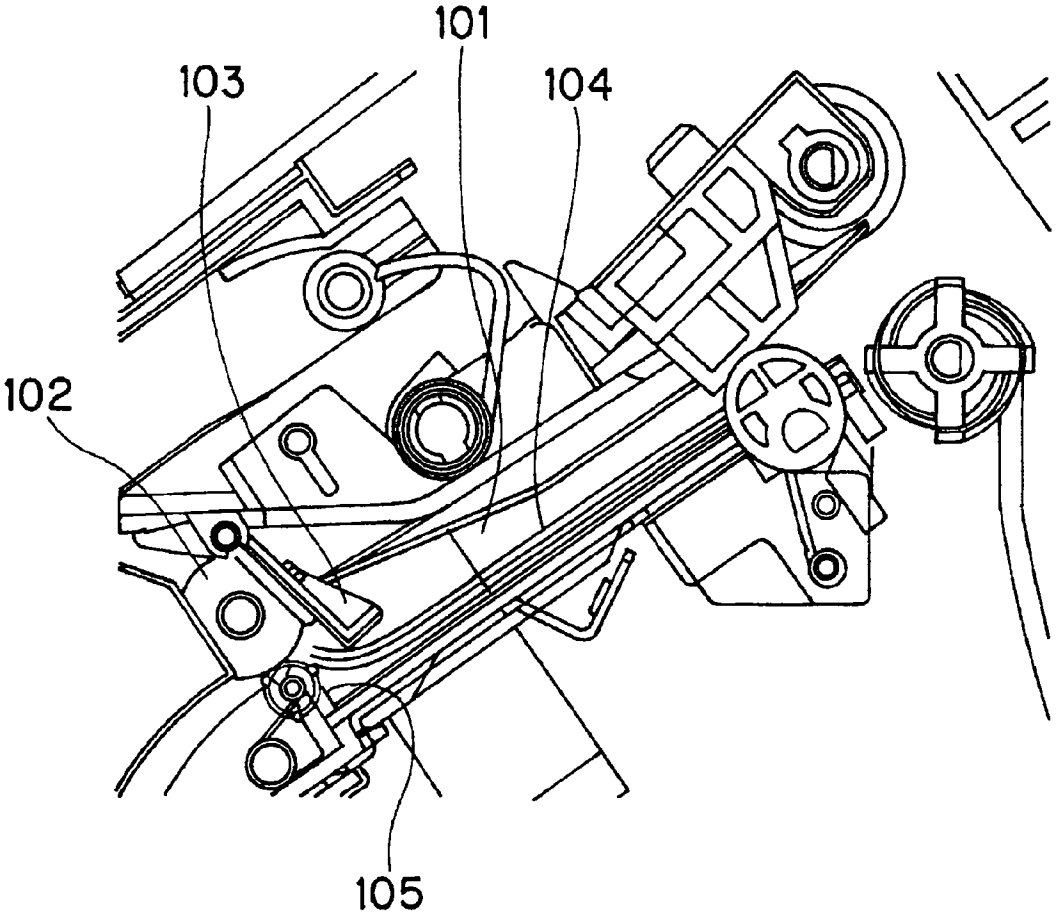
Fig. 15 PRIOR ART
FIG. 15 is a view showing the prior art.

Next, a sheet processing apparatus in accordance with a third embodiment of the present invention is described. FIGS. 12 and 13 show the third embodiment of the present invention. Explanation of the same components as those of the first and second embodiments is not repeated here.

The structure of the third embodiment includes a sensor 46 as a location detecting portion (location detecting means) that detects the location of the first holding member 38. A detection portion 47 of the first holding member 38 is detected to detect whether the first holding member 38 has returned to the predetermined restricting position.

In a case where the first holding member 38 should be in the restricting position, the sensor 46 might detect that the first holding member 38 has not returned to the restricting position due to tight curling or the like of the trailing end of a sheet S, as shown in FIG. 12. In such a case, the first holding member 38 is determined not to hold down the trailing end of the sheet in the intermediate stacking portion 34 below the nip line of the intermediate conveyance roller 32 with a controller (control means). In the first embodiment, the case where the first holding member 38 should be in the restricting position is a case where the sheet is not in contact with the first contact portion 38*c* of the first holding member 38, or a case where the sheet does not exist in the region of the sheet conveying path in which the sheet is brought into contact with the first contact portion 38*c*. In the second embodiment, the case where the first holding member 38 should be in the restricting position is a case where the solenoid 45 is released.

In those cases, the conveying portion (conveying means) is controlled by the controller (control means), so as to stop the conveyance of the succeeding sheet to the intermediate stacking portion 34. Thus, sheet jamming or the like can be prevented.

In a case where the sensor 46 detects that the first holding member 38 has not returned to the predetermined restricting position as the thickness of the stack of sheets S placed in the intermediate stacking portion 34 becomes larger than the largest possible thickness for stapling, as shown in FIG. 13, the controller (control means) stops the stapling in the subject job. Thus, the stapler can be prevented from breaking down due to stapling of a sheet stack with a larger thickness than the largest possible thickness for a stack of sheets to be stapled.

Here, the controller (control means) may at least stop the operation of the above described sheet processing, or may stop the operation of the entire sheet processing apparatus. The controller (control means) that controls the operation of the sheet processing apparatus may be provided in the sheet processing portion 3, or the controller (control means) in the image forming portion 1 that controls the entire image forming apparatus may have the functions of a controller for sheet processing and directly control sheet processing operations.

This application claims priority from Japanese Patent Application No. 2005-128083 filed Apr. 26, 2005, which is hereby incorporated by reference, herein.

What is claimed is:

1. A sheet processing apparatus comprising:

a sheet stacking portion on which sheets are stacked;

a conveying portion which conveys a sheet onto the sheet stacking portion;

a reference wall against which an upstream end portion in a sheet conveying direction of the sheet, conveyed onto the sheet stacking portion, is abutted;

a first restriction member which has a first restriction portion crossing the reference wall, the first restriction portion preventing lift of the upstream end portion of the sheet stacked on the sheet stacking portion; and a second restriction member which has a second restriction portion located downstream of the reference wall, the second restriction portion preventing lift of the upstream end portion of the sheet stacked on the sheet stacking portion, wherein each of the first restriction member and the second restriction member is moveable, by a pushing force of a sheet being conveyed, between respective restricting positions in which the lift of the upstream end portion of the sheet stacked on the sheet stacking portion is prevented and respective retracting positions to which each restriction member is retracted from each restricting position, wherein the second restriction member moves from the restricting position to the retracting position after the first restriction member moves from the restricting position to the retracting position as the sheet is introduced to the sheet stacking portion, and wherein each of the first restriction member and the second restriction member moves from each retracting position to each restricting position as the sheet passes.

2. The sheet processing apparatus according to claim 1, wherein the first restriction member has a first contact portion to be in contact with the sheet being conveyed along a sheet conveying path, the first contact portion being located upstream of the reference wall in the sheet conveying direction, and being located upstream of a second contact portion of the second restriction member to be in contact with the sheet in the sheet conveying direction, and wherein each of the first restriction member and the second restriction member can be moved from each restricting position to each retracting position when the sheet being conveyed along the sheet conveying path comes into contact with the first contact portion and the second contact portion.

3. The sheet processing apparatus according to claim 2, further comprising:

a swinging axis which supports the first restriction member swingably between the restricting position and the retracting position, wherein the swinging axis is provided upstream of the first contact portion in the sheet conveying direction.

4. The sheet processing apparatus according to claim 1, further comprising:

an energizing member which energizes the first restriction member in a direction in which the first restriction member is located at the restricting position.

5. The sheet processing apparatus according to claim 1, further comprising:

a sheet detecting portion which detects each sheet being conveyed along the sheet conveying path and introduced to the sheet stacking portion; and a moving portion which moves at least one of the first restriction member and the second restriction member between each restricting position and each retracting position, based on a detection result of the sheet detecting portion.

6. The sheet processing apparatus according to claim 5, further comprising:

a contact portion with which each sheet being conveyed along the sheet conveying path is brought into contact, the contact portion being provided in one of the first restriction member and the second restriction member that is not moved by the moving portion, wherein the moving portion moves one of the first restriction member and the second restriction member from each restriction position to each retracting position while a sheet is being conveyed along the sheet conveying path.

7. The sheet processing apparatus according to claim 1, wherein the upstream end portion is restricted by the first restriction portion on the side of a sheet stacking face of the sheet stacking portion rather than the second restriction portion.

8. The sheet processing apparatus according to claim 1, wherein a plurality of first restriction members and a plurality of second restriction members are arranged in a direction perpendicular to the sheet conveying direction.

9. The sheet processing apparatus according to claim 1, further comprising:

a location detecting portion which detects the location of the first restriction member; and a controller which stops at least an operation relating to sheet processing when the location detecting portion detects the first restriction member not being located in the restricting position though the first restriction member needs to be located in the restricting position.

10. The sheet processing apparatus according to claim 1, further comprising:

a sheet processing portion which processes the sheets stacked on the sheet stacking portion, wherein the restricting position of the first restriction member is set so that the thickness of a stack of sheets, which are stacked on the sheet stacking portion and have upstream end portions restricted by the first restriction member located in the restricting position, is a thickness which will not interfere with the operation of the sheet processing portion.

* * * * *